US006196953B1

(12) United States Patent
Buchanan

(10) Patent No.: US 6,196,953 B1
(45) Date of Patent: Mar. 6, 2001

(54) MULTI-PIECE TUBULAR BARBELL BAR

(76) Inventor: Matthew D. Buchanan, 415 N. Fair St., Olney, IL (US) 62450

( * ) Notice: Subject to any disclaimer, the term of this patent is extended or adjusted under 35 U.S.C. 154(b) by 0 days.

(21) Appl. No.: 09/191,302

(22) Filed: Nov. 13, 1998

(51) Int. Cl.[7] ..... A63B 23/14
(52) U.S. Cl. ..... 482/114; 482/118
(58) Field of Search ..... 482/126, 109, 482/104, 127, 114, 115, 118; 403/347, 373, 374.1, 374.3, 362

(56) References Cited

U.S. PATENT DOCUMENTS 579,519 * 3/1897 Loeber ..... 403/387
2,998,219 * 8/1961 Riddle ..... 403/389
3,231,270 * 1/1966 Winer ..... 482/106
4,351,348 9/1982 Axton .
4,682,774 * 7/1987 Holy ..... 482/104
5,441,471 * 8/1995 Passer ..... 482/106
5,536,107 * 7/1996 Baker ..... 403/389
5,538,354 * 7/1996 Simond ..... 403/109
5,697,871 * 12/1997 Landfair ..... 482/82
5,803,426 * 9/1998 Hart ..... 403/374
5,876,147 * 3/1999 Longo ..... 403/374.3

* cited by examiner

*Primary Examiner*—Jerome W. Donnelly
(74) *Attorney, Agent, or Firm*—Polster, Lieder, Woodruff & Lucchesi, LLC

(57) ABSTRACT

A multi-piece barbell bar is tubular, the pieces of the bar being provide with a retainer that permits the pieces easily to be joined permanently, free of relative movement with respect to one another, without tools.

12 Claims, 1 Drawing Sheet

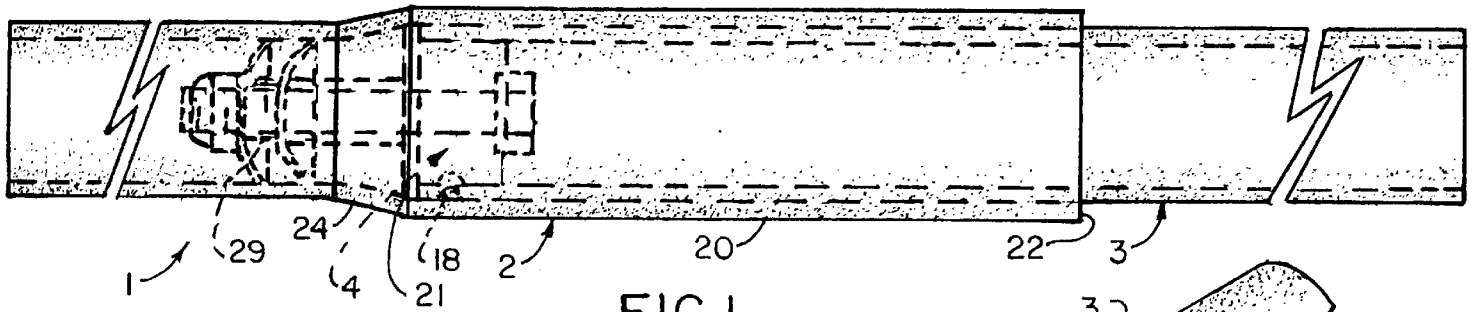
FIG. 1
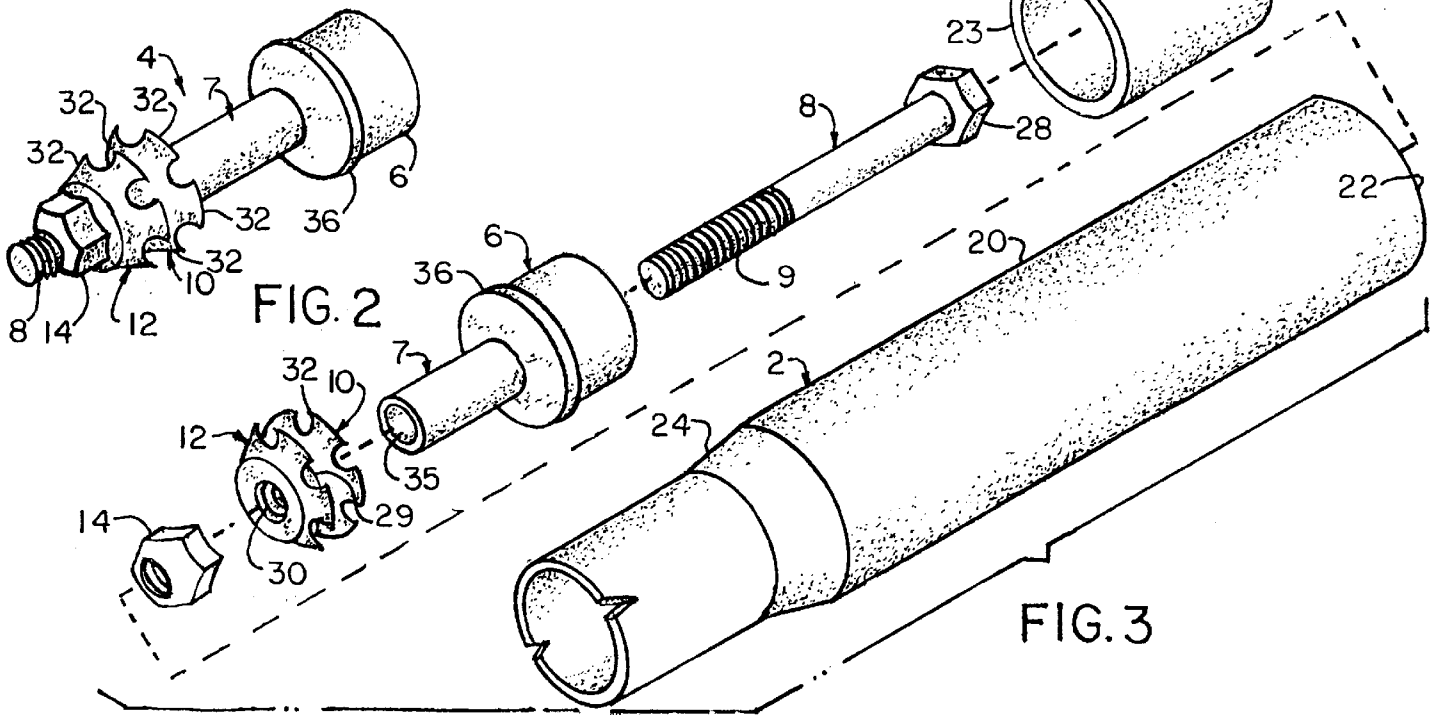
FIG. 2
FIG. 3

MULTI-PIECE TUBULAR BARBELL BAR

BACKGROUND OF THE INVENTION

This invention relates to barbell bars, and in particular multi piece barbell bars designed to be permanently joined into a single bar. The use of barbells with various removable weights is popular as a method of exercise. The barbells typically employed for weight lifting have solid steel bars that are between 60 inches (5 feet) and 86.6 inches (a little over 7 feet) in length. The length of the bars makes transportation potentially difficult, especially for a purchaser who transports a bar in a car. Storage of the barbell bars in retail stores has also been awkward, because the overall length of the bars requires either more shelf space or vertical storage. Multi-piece barbell bars have been developed to ameliorate the problem of transportation and storage. Most of them have been two piece bars, which have either a threaded member and a female receiving member that interlock to join the two bars, or cooperating flanged portions that interengage to form a unitary bar. A problem with these solutions is that the bars tend to rotate with respect to one another, and could potentially come apart, or do not present a smooth, uninterrupted span between their ends. The solid steel bars are also heavy and relatively expensive as compared with a tubular bar.

BRIEF SUMMARY OF THE INVENTION

It is therefore an object of the present invention to provide a multi-piece barbell bar that does not come apart.

It is a further object of the present invention to provide a multi-piece barbell bar wherein the pieces do not rotate with respect to one another.

It is a further object of the present invention to provide a multi-piece barbell bar that is inexpensive to manufacture, simple to assemble, and relatively light but sturdy in construction.

Other advantages and desirable objects of the present invention will occur to those skilled in the art in light of the following description and accompanying drawings.

Briefly stated, a multi-piece tubular barbell bar with a unique connector intermediate the pieces is disclosed. The illustrative embodiment shown and described is a two-piece bar, but it will be immediately apparent to those skilled in the art that the teaching of the disclosure is applicable to three or more parts. In the preferred embodiment, the connector has a cylindrical base member and a projecting member that projects from the base member. The base member and the projecting member have aligned openings through which a bolt is passed, so that a threaded portion of the bolt projects above the projecting member. In the preferred embodiment, the bolt has a noncircular head, as for example a hex head, which seats in a socket in the base member. At least one locking washer is mounted on the threaded portion of the bolt, and a lock nut tightened down on the threaded portion of the bolt against the locking washer. In the preferred embodiment, two locking washers are used, with an integral spacer between them, preferably with a threaded bore, which is threaded onto the bolt, but the washer or washers can be spot welded or otherwise secured against movement on the bolt.

The bar is tubular, rather than solid. In the preferred embodiment, an end of a first bar segment is expanded to the extent that, when assembled, a facing end of the other, second, bar segment fits closely within the expanded section, and seats against a shoulder at the inner end of the expanded section. Before it is assembled, the connector is secured in the unexpanded end of the second bar segment, with the projecting member and lock washers projecting from that end, and the bar is staked into the cylindrical base or body portion of the connector, or spot welded or brazed to the body, in any event securing the body against any movement with respect to the segment into which it is mounted. The lock washers are sized to be deflected inwardly as they are forced into the unexpanded part of the first bar segment end, and to dig into the inner surface of the tubular bar, making it virtually impossible to retract the second segment from the first, after the two are assembled. The two segments are shipped to a destination, for example a retail store, where the barbell is displayed for sale. The final stage of assembly is performed either at the retail store, or by a consumer who purchases the barbell. In either case, the two pieces are assembled by inserting the second segment, with the connector in place, into the expanded section of the first segment, and forcefully urging the two segments together until the end of the second section seats on the shoulder of the first section and the locking washers are forced into the unexpanded part of the first section. As has been explained, the locking washers then act to hold the barbell segments together in a permanently fixed relation.

BRIEF DESCRIPTION OF THE SEVERAL VIEWS OF THE DRAWINGS

In the drawings, FIG. 1 is a partial phantom, fragmentary view in side elevation of a barbell bar of the present invention;

FIG. 2 is a perspective view of one embodiment of connector of the present invention. and FIG. 3 is an exploded view of a connector assembly of a barbell bar of the present invention

DETAILED DESCRIPTION OF THE INVENTION

Referring now to the drawings, FIG. 1 shows the center portion of an assembled barbell bar of the present invention. In this illustrative embodiment, the barbell bar 1 is composed of two, tubular, open-ended, interengaging sections, a first section 2 and a second section 3. At one open end 22, the section 2 has an expanded portion 20 that is sufficiently larger in inside diameter than the outside diameter of an unexpanded open end 23 of section 3 to admit the unexpanded part of the section 3 closely, with no appreciable play between them. The expanded portion 20 terminates in a necked down, smoothly tapering portion 24, which, inside the tube, forms a shoulder 21. The interengaging sections 2 and 3 are held in place by a connector 4. Connector 4 has a cylindrical base member 6 and a hollow projecting member 7, preferably integral with the base member, through which an axial passage 35 extends. The base member 6 is of a diameter to fit snugly within the end of the second section 3, and has a flange 36 at its outer end, which has an outside diameter of the outside diameter of the section 3. The flange 36 abuts the end of the second section 3, locating the base member axially when the base member is mounted in the end of the second section. The base member has a socket in a radial surface at its inner end. A bolt 8, with a head 28 and a threaded section 9, passes through the passage 35 of base member 6 and hollow projecting member 7 from which at least a part of the threaded section 9 projects. The head 28, which in the embodiment shown, is hexagonal, seats in the socket in the inner radial surface the base 6, as indicated in FIG. 1. The socket is also hexagonal, so that once seated, the bolt cannot rotate with respect to the base. Retaining members in the form of lock washers 10 and 12 have central openings 30, through which the projecting threaded section of the bolt 8 extends. The washers 10 and 12 have a spacer 29, preferably integral with the washers themselves, between them. The washers 10 and 12 are made of spring steel and have sharp-edged prongs or fingers 32, deflectable sufficiently to permit their insertion into the unexpanded part of the bar section 2, but stiff enough to cause them to gouge into the inner wall of the tubular section 2 sufficiently to anchor the section 3 inside the expanded part of the section 2 against any force that is likely to be exerted in a direction to dislodge it. As can be seen from the drawings, the prongs slant toward the base 6, to permit their insertion into the unexpanded part of section 2, but to tend to expand them radially in response to an axial force in the opposite direction.

In the first phase of assembling the bar, the connector 4 is first assembled, as shown in FIG. 2. As has been indicated, the bolt 8 is passed through the passage 35 until the head of the bolt is seated in a socket in the inner radial surface of the base. The lock washers 10 and 12 are mounted on the projecting threaded part of the bolt 8 and held by a lock nut 14. As has been indicated, the spacer is preferably internally threaded, and is screwed onto the threaded part of the bolt, until the inner of the lock washers is tight against the free end of the projecting member 7. When the lock nut 14 is screwed down tightly against the outer of the lock washers, they are held securely against both rotation and translation. The base 6 is then mounted in the open end of the section 3, and staked, as indicated at 18 in FIG. 1, or otherwise secured against movement in any direction. Merely by way of illustration, the bar can be made of high strength, heavy 14 gauge steel tubing, 1" in diameter.

In the final phase of assembling, the end of the second section 3 from which the projecting member 7 of the connector extends, is slid into the expanded section of the first section 2, and the lock washers 10 and 12 forced into the unexpanded part of the section until the base flange 36 at the end of the second section abuts the shoulder 21. Because the effective diameter of the lock washers is greater than the inside diameter of the unexpanded part of the section into which they are forced, and because the prongs are sloped toward the base, the prongs are deflected radially inwardly, to permit their insertion. The prongs dig into the inner wall of the unexpanded part into which they are forced. A force tending to withdraw the section will cause the prongs to tend to move outwardly radially, increasing their grip. Accordingly, once assembled, the bar will not come apart in response to any force that is likely to be exerted on it. It is to be observed that the two segments of the barbell bar of this invention can be assembled easily by the purchaser without tools. The bar is assembled permanently, as far as its use as a barbell bar is concerned. In practice, a plastic sleeve is mounted over the bar to extend between weights when they are mounted between collars at the ends of the bar, as is conventional. The ends of the tube can be plugged or capped to finish them.

Numerous variations within the scope of the appended claims will occur to those skilled in the art in light of the foregoing disclosure. For example, the base member need not be cylindrical, but can be polygonal or oval in cross section. The bar itself can be oval or polygonal in section. The lock washers can be mounted on a stub shaft integral with the projection 7, eliminating the bolt 8. If that shaft is made non-circular in cross section, and holes in the washers made complementarily, the washers cannot rotate on the shaft. and no other provision need be made for securing them against rotation. The shaft can be peened or headed tightly against the washer or washers, to eliminate the lock nut, although the embodiment shown and described is preferred. A single lock washer can be used, although more than one is preferred. Other retaining means can be used, such as a pin, spring loaded, to spring into a cavity in the section 2. Although the open end of the enlarged part of the first section 2 is illustrated as squared off, it can be, and preferably is, rounded and tapered so as to make its transition to the diameter of the second section smooth. In lieu of providing the socket in the base, the head of the bolt can be spot welded or otherwise secured against turning on a flat radial surface of the base after it has been inserted in the passage 35. As has been indicated, the bar can be made in more than two sections, one or more intermediate sections each having an expanded part at one end and a connector at another end, or two expanded ends to receive connectors mounted in facing ends of other sections, or two connectors to be mounted in expanded sections of facing ends of other sections. These examples are merely illustrative, and are not intended to limit the scope of the appended claims.

What is claimed is:

1. A multi-piece barbell bar comprising at least a first hollow, open ended bar segment, said first hollow bar segment having an enlarged portion at one end thereof, said enlarged portion being open at one end and forming an internal shoulder at a fixed distance from said open end; at least a second hollow bar segment, said second hollow bar segment having an open end with an outside diameter sufficiently smaller than the inside diameter of the open end of said enlarged portion of said first bar segment to permit the end of said second end to be received closely within said enlarged portion of said first bar segment and to abut said shoulder of said first bar segment; and a fastener assembly mounted within said open end of said second bar segment.

2. The barbell bar of claim 1 wherein said fastener assembly has a base member adapted to be secured within said open end of said second bar segment, and a projecting member, said projecting member having a retaining member sized to fit within said first hollow bar segment at a point beyond said enlarged portion and said shoulder portion of said first hollow bar segment when said second hollow bar segment is engaged in said first hollow bar segment.

3. The barbell bar of claim 2 wherein the retaining member is a lock washer.

4. The barbell bar of claim 3 further including a bolt, said bolt passing through said base member, said projecting member and said lock washer, said lock washer being secured to said bolt.

5. The barbell bar of claim 4 wherein said bolt has a threaded section, the lock washer has a threaded section complementary to said bolt threaded section and is screwed down on the bolt threaded section tightly against said projecting member, and a lock nut is screwed down on the bolt threaded section tightly against said lock washer.

6. The barbell bar of claim 2 wherein said bar segments and said base member of said assembly are cylindrical, circular in cross section.

7. The multi-piece barbell bar of claim 1 including at least three segments, two of which are equipped to receive weights, and any other of which is not equipped to receive weights.

8. The multi-piece barbell bar of claim 7 wherein a segment of the bar not equipped to receive weights has a connector at one end and an open-ended enlarged portion at another end adapted to receive a connector on an end of a contiguous segment.

9. The multi-piece barbell bar of claim 7 wherein a segment of the bar not equipped to receive weights has a connector at two ends, and ends of other segments continuous said connector ends have enlarged portions adapted to receive said connectors.

10. The multi-piece barbell bar of claim 7 wherein a segment of the bar not equipped to receive weights has an enlarged portion at two ends and facing ends of other segments have connectors mounted in and engaging said enlarged portions.

11. A two piece barbell bar comprising a first hollow, open ended bar segment, said first hollow bar segment having an enlarged portion at one end thereof, said enlarged portion being open at one end and forming an interior shoulder at a fixed distance from said open end; a second hollow bar segment, said second hollow bar segment having an open end with an outside diameter sufficiently smaller than the inside diameter of the open end of said enlarged portion of said first bar segment to permit the end of said second bar member to be closely received within said enlarged portion of said first bar member and abut said shoulder of said first bar member; and a fastener assembly mounted within said open end of said second bar member, said fastener assembly having a base member adapted to be secured within said open end of said second bar member and a projecting member integral with said base member, said base and projecting members having an axially directed passage through them; a bolt passing through said base and projecting member passage, and a lock washer secured to said bolt, said lock washer having a multiplicity of prongs sized to be manually forceable within said first hollow bar segment at a point beyond said enlarged portion and said shoulder portion of said first hollow bar segment when said second hollow bar segment is seated in said first hollow bar segment to cause said prong members to dig into an inner surface of said first hollow bar segment.

12. The barbell bar of claim 11 wherein said bolt has a threaded section, the lock washer has a threaded section complementary to said bolt threaded section and is screwed down on the bolt threaded section tightly against said projecting member, and a lock nut is screwed down on the bolt threaded section tightly against said lock washer.

* * * * *